US005149301A

United States Patent [19]

Gates

[11] Patent Number: 5,149,301

[45] Date of Patent: Sep. 22, 1992

[54] BAFFLE MEANS FOR ROOF RIDGE VENTILATOR

[75] Inventor: Thomas A. Gates, Sidney, Ohio

[73] Assignee: Aluminum Company of America, Pittsburgh, Pa.

[21] Appl. No.: 749,182

[22] Filed: Aug. 23, 1991

[51] Int. Cl.[5] ..... F24F 7/02

[52] U.S. Cl. ..... 454/365; 52/199

[58] Field of Search ..... 52/199; 98/42.2, 42.21, 98/42.22

[56] References Cited

U.S. PATENT DOCUMENTS

| | | | |
|---|---|---|---|
| 3,481,263 | 12/1969 | Belden | 98/42.21 |
| 4,903,445 | 2/1990 | Mankowski | 98/42.21 X |
| 5,009,149 | 4/1991 | MacLeod et al. | 98/42.21 |
| 5,052,286 | 10/1991 | Tubbesing et al. | 98/42.21 |

FOREIGN PATENT DOCUMENTS

| | | | |
|---|---|---|---|
| 427904 | 5/1935 | United Kingdom | 98/42.21 |
| 562869 | 7/1944 | United Kingdom | 98/42.21 |

*Primary Examiner*—Harold Joyce
*Attorney, Agent, or Firm*—Elroy Strickland

[57] ABSTRACT

A ventilator for straddling an aperture in a roof of a building, the ventilator comprising at least one rectangular cover panel having an interior surface and an exterior surface. A plurality of longitudinally spaced interior walls are provided for supporting the panel over the aperture, with each wall having a portion extending beyond the edge of the panel. A longitudinally extending baffle wall is spaced outwardly from the panel edge and is supported in an upward direction by the lateral portions of the interior walls. A plurality of openings are provided in the baffle wall for draining water from the ventilator, and an upstanding baffle is spaced inwardly of and in line with each opening to deflect any wind-driven rain or snow entering through the opening from entering into the roof aperture.

2 Claims, 3 Drawing Sheets

BAFFLE MEANS FOR ROOF RIDGE VENTILATOR

BACKGROUND OF THE INVENTION

The present invention relates generally to ventilators for disposal over an open roof ridge of a building, and particularly to deflecting walls located behind openings in outer baffles of a ventilator to prevent or at least severely limit wind-driven rain and/or snow entering through the openings from entering into the interior of the ventilator and building.

A number of U.S. patents show the use of openings in the outer walls or baffles of a roof ridge ventilator. These include U.S. Pat. Nos. 3,481,263, 4,558,637 and 4,903,445 to Belden, Mason and Mankowski respectively. None of these patents show means that would be effective to prevent the entry of wind-driven water or snow into the ventilator unit and thus into the attic area of the building on which the unit is disposed.

BRIEF SUMMARY OF THE INVENTION

The present invention is directed to the use of small openings provided in longitudinally extending outer wall baffles of a roof ridge ventilator to permit any moisture or water in the ventilator to drain from the ventilator, and an upstanding wind deflecting baffle located behind each opening to prevent wind-driven rain and other types of moisture from entering the ventilator.

The deflecting baffles of the invention have proven their ability to prevent the entry of wind-driven rain and moisture. For example, panels provided with the subject deflecting baffles were tested in Miami, Fla. under hurricane velocity winds; no rain was able to enter the ventilator and thus enter the attic. Instead, the rain water struck each deflecting baffle and was diverted vertically from the ventilator and through a space that separates the longitudinal baffle and the main body of the panel. From there, the wind was effective in blowing water and moisture away from the panel and building. The ventilator has been approved by Dade County in Florida; the County requires the passing of stringent tests before it gives its approval to building products for sale and use in the County.

The longitudinal outside baffles are designed to create negative pressure that is effective to draw air from an attic. This is accomplished by the movement of air over the longitudinal baffles in a manner similar to the movement of air over the wing of an airplane. The upstanding wind deflecting baffles located behind each drain hole assists in this creation of negative pressure, as air also moves over such baffles.

Additional means are provided to assure proper alignment and connection of adjacent ventilators, as discussed in detail hereinafter.

THE DRAWINGS

The invention, along with its objectives and advantages, will best be understood from consideration of the following detailed description and the accompanying drawings in which.

Figure 1:
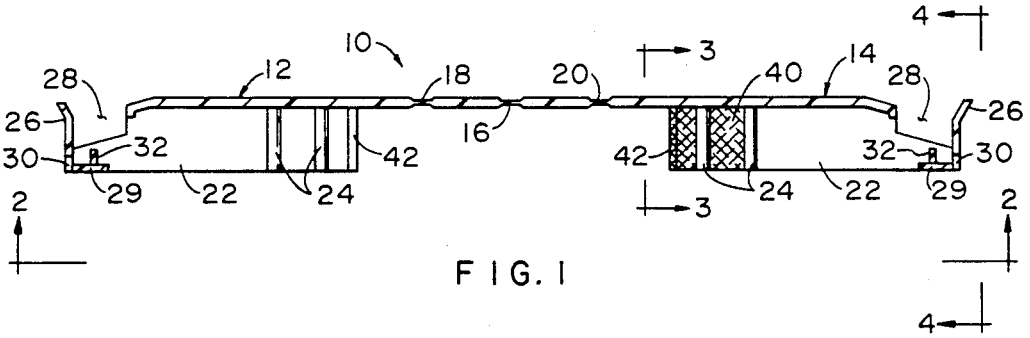
FIG. 1 is a sectional view of a roof ridge ventilator having upstanding lateral (outer) baffles located along the longitudinal edges of ventilator panels, and wind deflecting inner baffles located behind the longitudinal baffles.
Figure 4:
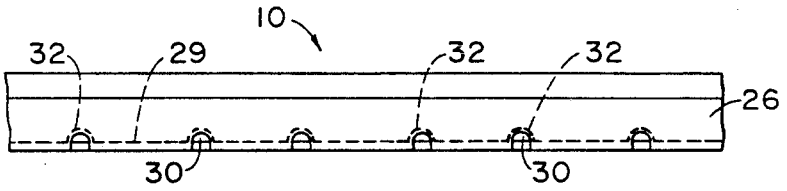
Figure 5:
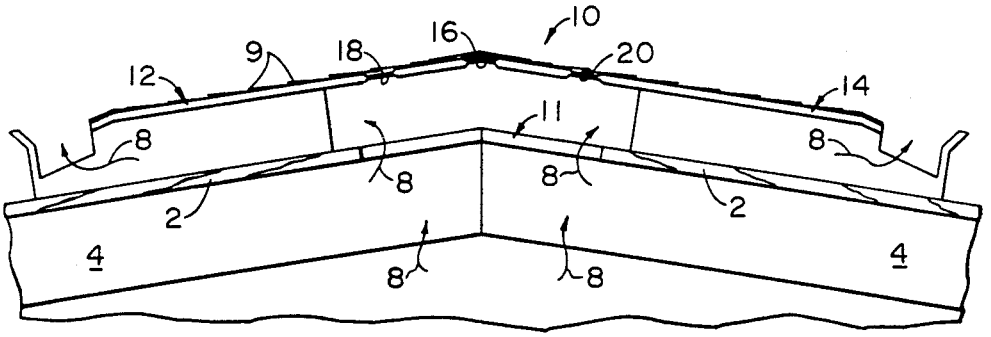
Figure 9:
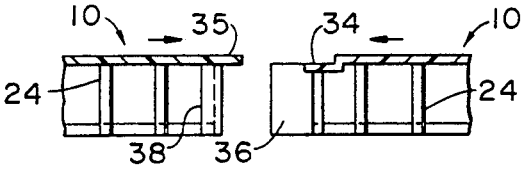
Figure 10:
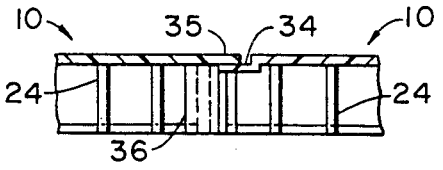
Figure 6:
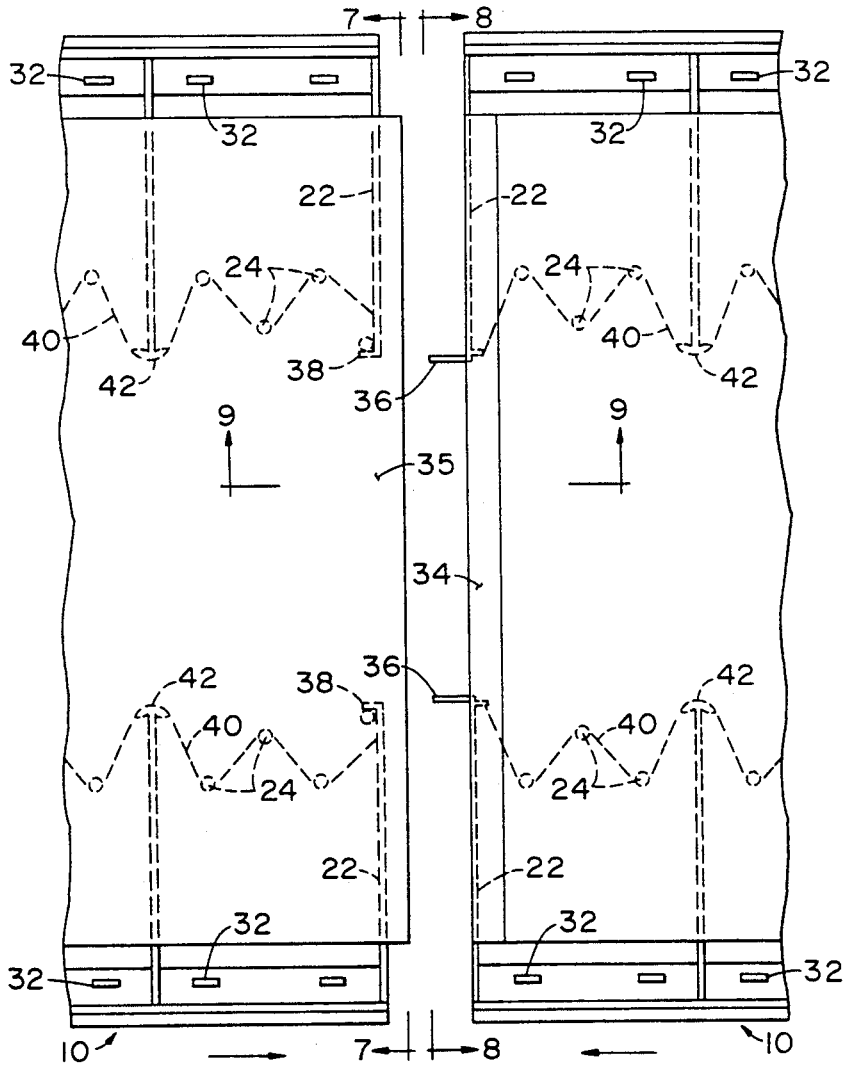
Figure 7:
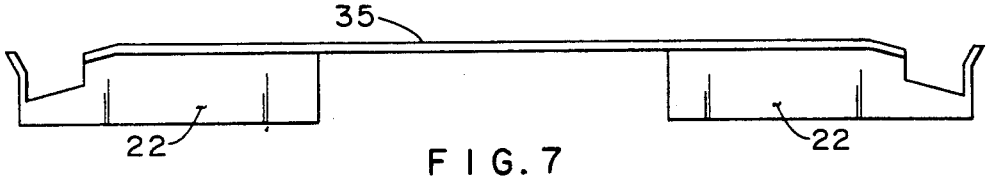
Figure 8:
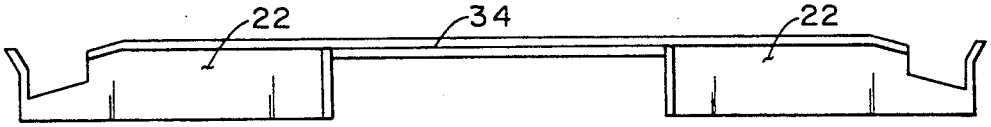

FIG. 4 is an outside view of the ventilator taken along lines 4—4 in FIG. 1, FIG. 5 is an end view of the ventilator, as it would appear on the incline of a roof surface and over an opening provided in the roof, FIG. 6 is a partial plan view of two ventilator panels of the subject invention, the ends of which are shown disposed adjacent each other, the figure showing, in addition, a mechanism for longitudinally aligning the panels when they are disposed together in a mating relationship, FIG. 7 is an end elevation view of the ventilator taken along lines 7—7 of FIG. 6, FIG. 8 is an end elevation view of the ventilator taken along lines 8—8 of FIG. 6, FIG. 9 is a partial sectional view of the end portions of two adjacent ventilators of FIG. 6 taken along lines 9—9 of FIG. 6, and FIG. 10 is a partial sectional view of the end portions of the ventilators of FIG. 9 disposed together in aligned, mating relationship.

PREFERRED EMBODIMENT

Referring now to FIG. 1 of the drawings, a low profile, generally rectangular ventilator 10 is shown is section, the ventilator being of the type suitable for securing to a building roof having an open or apertured ridge 11, as shown in FIG. 5 of the drawings . As shown in FIG. 5, ventilator 10 is located astraddle an aperture or opening 11 provided in roof decking 2 and between rafters 4 of the roof, through which the area beneath the rafters is ventilated. As shown, the inner ends of rafters abut against each other, while the decking, which is nailed to the upper surfaces of the rafters, stops short of the roof center to leave a space (11) between the upper edges of the decking. The roof structure may include in center beam (not shown) to which the rafter ends are nailed. In such a case, the upward movement of air would flow around the beam.

Preferably, the ventilator is seated on shingles(not shown) that are secured to decking 2 up to the location of the edges of the decking that define openings 11.

Such a ventilator allows the atmosphere within the building, and particularly in the upper or attic regions of a building to rise upwardly through the ventilator and to the atmosphere outside of the building, as indicated by arrows 8 in FIG. 5 while simultaneously closing the open ridge against the entry of rain and snow. The ventilator, in addition, allows cap shingles 9 to be nailed to the upper surfaces of the ventilator so that the ventilator itself is obscured and protected by such shingles.

Ventilator 10 comprises two panel portions 12 and 14 that overly the respective surfaces of a roof (FIG. 5) on each side of opening or aperture 11. The panels extend lengthwise of the roof. The combined widths of the panel portions are adapted to the length of a standard ridge cap shingle so that when the cap shingle is attached to the panel portions it will cover the ventilator and extend to a location slightly beyond the outer edge of each panel portion.

Panel portions 12 and 14 are separated by a narrow reduction 16 in the thickness of the panels. Such a reduced thickness allows the ventilator to be more easily flexed and thereby facilitate fitting the panels to the contour of a roof ridge. A typical shape is that shown in FIG. 5 of the drawings. Two additional, parallel reductions in panel thickness are shown at 18 and 20. Reductions 18 and 20 allow similar flexing and curving of the panels so that shingles disposed and secured thereon can more easily conform to the curve of the panels, while panels themselves can more easily conform to different roof profiles.

Figure 2:
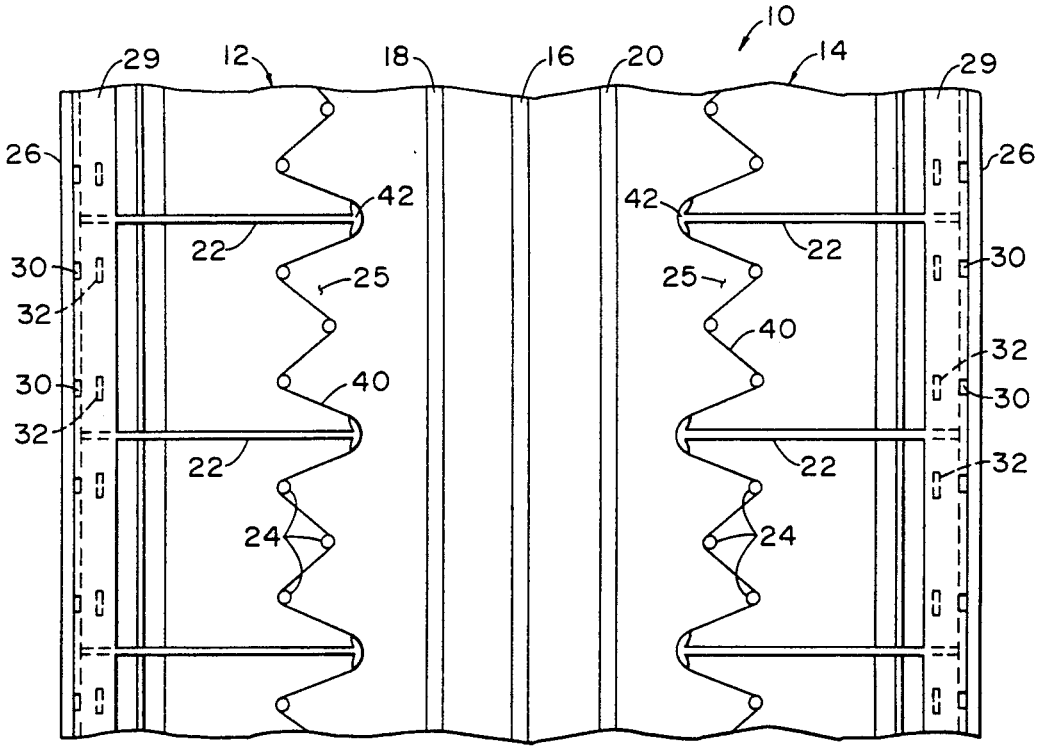
FIG. 2 is a partial inside plan view of the ventilator taken along lines 2—2 in FIG. 1.
Figure 3:
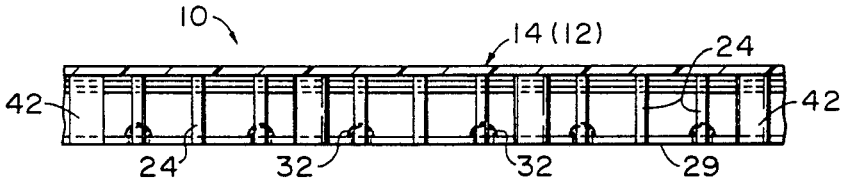
FIG. 3 is an inside view of the ventilator taken along lines 3—3 in FIG. 1.

Panels 12 and 14 are supported on and spaced from a roof surface (not shown) by internal wall structures 22 and posts 24. 22 and 24 extend downwardly from the inner surfaces of the panels, as best seen in FIGS. 1 and 3. Wall structures 22, in addition, are spaced apart lengthwise of the panels and extend crosswise of the panels, as best seen in FIG. 2. Open spaces 25 are thereby provided between the panels. The extent of wall structures 22 is from locations spaced from reduce portions 18 and 20 in the interior of the panels to locations beyond the lateral edges of the panels. This is best seen in FIGS. 1 and 2.

At the outer lateral edges of ventilator 10 are located upstanding baffles or walls 26 (FIG. 1) that extend longitudinally of panels 12 and 14 (FIG. 2) to create the negative pressure, as explained earlier, above the ventilator. Upstanding baffles 26 are spaced from the lateral edges panels 12 and 14 and are supported at and by the outer ends of interior walls 22. Since the outer ends of the interior walls lie beyond the lateral edges of the panels, open spaces 28 are provided between baffles 26 and the edges of panels. Open spaces 28 communicate with the spaces 25 between the interior walls 22 of the panels such that the interior of the building and ventilator communicates with the atmosphere outside of the building and ventilator. The negative pressure above the ventilator created by the baffles draws the atmosphere inside the building through spaces 25 and 28 to the area outside the building and ventilator.

In FIG. 1, a narrow lip or wall portion 29 is shown extending inwardly from the lower edge of each baffle 26. Lip 29 is flush with the lower edge of each support wall 22 and thus assists in supporting the outer reaches of ventilator on a roof surface.

Lateral longitudinal baffles 26 are provided with openings 30 that permit moisture and water on the roof surface beneath panels 12 and 14 to flow from the ventilator and down the roof surface in a well known manner. Otherwise, rain or snow entering the ventilator through lateral spaces 28 would be trapped in the ventilator. Accumulation of such rain or snow would then overflow into the open ridge of the roof and thus into the building.

Wind driven rain and/or snow enters into the ventilator through such drain openings as 30 unless some means is provided to prevent such inward flow, i.e., wind travels along a roof surface, and carries rain and snow up the incline of a pitched roof and into baffle openings, such as 30.

The present invention prevents this from occurring by locating an upstanding, inner, wind deflecting baffle 32 behind each drain opening 30. As best seen in FIGS. 2 and 3, two such openings and baffles are provided between interior support walls 22. As seen in FIG. 1, inner baffles 32 are located in spaces 28 such that when rain and/or snow is driven through openings 30 and against baffle 32, the rain or snow is directed upwardly through space 28. When such deflected rain or snow reaches a point beyond the upper surface of panels 12 and 14, the wind carries the rain or snow away from the ventilator and from the building. In this manner, rain or snow does not enter the building through the ventilator and the opening in the roof ridge.

The size of the inner deflecting baffle 32 is somewhat larger than areas of openings 30 so that any incoming rain or snow is certain to be received and deflected by the walls. This is seen in FIGS. 2 through 4. In the case of the ventilator units tested by Dale Counter, as discussed earlier, openings 30 were on order of one-quarter of an inch wide, with the baffles 32 being spaced from the openings about one quarter of an inch. Such a baffle location proved highly effective in diverting wind driven water from the ventilator.

Each ventilator 10 has, of course, two ends. As shown in FIGS. 6 to 10, one end is provided with a leading edge that is offset to form a relatively shallow recess 34. The other end has a relatively short extension 35. The recess 34 and extension 35 extend the full widths of panels 12 and 14, as seen in FIGS. 6 to 8. When two ventilators are disposed together in end-to-end relationship on the ridge of a roof, extension 35 slips over and seats in recess 34, as shown in FIG. 10 of the drawings. In FIG. 6, the offset and recess 34 are shown in plan view on the right hand panel, and extension 35 shown on the left hand panel. FIG. 7 of the drawings shows the edge of extension 35 in end elevation, while FIG. 8 shows the edge of recess 34 in end elevation.

The overlap of the two ventilators provides a seal between their ends so that the negative pressure provided by outer baffles 26 and inner baffles 32 is not lost or compromised by loosely fitting ventilators.

The integrity of the connection between the two abutting ventilators is assured by the panels being located in precise longitudinal alignment. Longitudinal alignment is effected and assured by two, parallel projections 36 located in and extending from the end of the panel having recess 34, and two planar surfaces 38 provided by the two L-shape wall structures 22 located at the end of the panel to be seated in recess 34. The projections and planar surfaces are in parallel alignment with the axes of the two adjacent ventilators so that when the ends of the two ventilators are brought together, the projections 36 of the one panel engage the surfaces 38 of the other panel to place the two ventilators in axial alignment. In this manner, when a series of the ventilators of the invention are located on a roof ridge, and are disposed together in end-to-end relationship, all ventilators of the series will be aligned to provide efficient internal venting of the area beneath the roof ridge since the projections 36 of the panels enter between the surfaces 38 of the panels.

In FIGS. 1 and 2 an open screen or mesh material 40 is shown supported beneath the panels of ventilator 10 by posts 24 and the inner ends of support walls 22. In the latter case, the ends of the support walls are shown provided with rounded flanges 42. The rounded flanges provide smooth curved surfaces that protect the screen or mesh material from being damaged by sharp corners that might otherwise exist at inner edges of the support walls. For the same reason, it is preferred that posts 24 be round, as shown.

Mesh 40 is a narrow strip of material, the height of which corresponds to that of the inner depth of panels 12 and 14, as provided by interior walls 22. In this manner, when ventilator 10 is disposed on a roof surface, the mesh material serves to close the areas of the panels inside of the strip locations against the entry of bugs and insects, and thus the entry of such bugs and insects into the building on which ventilator 10 is disposed. The strips of mesh or screen material are held in place by being disposed about posts 24 and flanges 42 in zig zag manner. Each strip extends and is suitably secured to the last inner wall 22 of each panel, as shown diagrammatically in FIG. 6 of the drawings.

The ventilator of the invention is preferably made as a single unitary structure by an injection molding process. The material of the ventilator can be a co-polymer provided with ultraviolet stabilized ingredients. A preferred material is polyethylene.

While the invention has been described in terms of preferred embodiments, the claims appended hereto are intended to encompass all embodiments which fall within the spirit of the invention.

What is claimed is:

1. A ventilator for straddling an aperture in the ridge of a roof comprising:

at least two rectangular cover panels joined together along one longitudinal edge thereof, with each panel having an interior surface and an exterior surface, said exterior surfaces being disposed to receive overlaying shingles when said panel is located on a roof ridge, and having narrow areas of reduced thickness extending lengthwise of the panels to permit conformance of the panels to the surface of the roof, a plurality of longitudinally spaced support walls extending downwardly from the interior surfaces of said panels to support the panels above the roof surface and permit air circulation through said aperture, with each of said support walls having a portion extending beyond the longitudinal edges of the cover panels located opposite the edges at which the panels are joined together, a substantially vertical baffle wall connecting the projecting ends of said support walls, and extending lengthwise of the panels and spaced from the longitudinal edges of the panels, a plurality of posts extending downwardly from the interior surfaces of the panels, at least one ribbon of open screen material extending generally lengthwise of each panel and supported within each panel by said posts and the inwardly facing ends of said longitudinally spaced walls, said baffle walls defining a plurality of openings for draining water from the ventilator, and a plurality of upwardly extending baffles associated with said openings and spaced inwardly therefrom toward the center of the panels and in line with the openings to deflect any wind driven rain or snow that may enter through said openings, and thereby substantially preclude any such rain or snow from entering the aperture in the roof.

2. The ventilator of claim 1 in which one end thereof is provided with two longitudinal projections, and the other end is provided with two parallel planar surfaces, said projections and surfaces being in parallel alignment with the longitudinal axis of the ventilator.

* * * * *